US011111072B2

(12) United States Patent
Bao

(10) Patent No.: US 11,111,072 B2
(45) Date of Patent: Sep. 7, 2021

(54) CUSHION STRUCTURE AND PACKAGE BOX

(71) Applicants: HKC Corporation Limited, Guangdong (CN); Chongqing HKC Optoelectronics Technology Co., Ltd., Chongqing (CN)

(72) Inventor: Wenqiang Bao, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/643,171

(22) PCT Filed: Jan. 11, 2018

(86) PCT No.: PCT/CN2018/072196
§ 371 (c)(1),
(2) Date: Feb. 28, 2020

(87) PCT Pub. No.: WO2019/041723
PCT Pub. Date: Mar. 7, 2019

(65) Prior Publication Data

US 2020/0262640 A1 Aug. 20, 2020

(30) Foreign Application Priority Data

Aug. 31, 2017 (CN) ..... 201710770519.1

(51) Int. Cl.
*B65D 81/127* (2006.01)
*B65D 25/10* (2006.01)
(Continued)

(52) U.S. Cl.
CPC ..... *B65D 85/48* (2013.01); *B65D 81/127* (2013.01); *B65D 25/10* (2013.01); *B65D 81/03* (2013.01); *B65D 81/113* (2013.01); *B65D 85/44* (2013.01)

(58) Field of Classification Search
CPC ..... B65D 85/48; B65D 81/127; B65D 25/10; B65D 81/03; B65D 81/113; B65D 81/44
(Continued)

(56) References Cited

U.S. PATENT DOCUMENTS 2,776,085 A * 1/1957 Furey ..... B65D 27/10 229/69
4,508,224 A * 4/1985 Weber ..... G03D 15/005 206/455
(Continued)

FOREIGN PATENT DOCUMENTS

CN 1935605 A 3/2007
CN 102700852 A 10/2012
(Continued)

*Primary Examiner* — Rafael A Ortiz
(74) *Attorney, Agent, or Firm* — Muncy, Geissler, Olds & Lowe, P.C.

(57) ABSTRACT

A cushion structure and a package box are provided, which relate to the technical field of a protection pad. The cushion structure comprises a cushion pad which includes a multi-layered folding structure and a plurality of folding layers. One end of one folding layer is connected to one head of another folding layer neighboring to the one of the folding layers, and the folding layers are disposed in an overlapped manner after being folded. An accommodating space is formed between neighboring two of the folding layers, and the accommodating space is configured to accommodate an object. A through hole is disposed on the folding layer to prevent the object from sticking with the folding layer. A reserved pad protrudes from an edge of each folding layer,
(Continued)

and two surfaces of the reserved pad are respectively coplanar with two surfaces of the each folding layer.

17 Claims, 2 Drawing Sheets

(51) Int. Cl.

| | |
|---|---|
| ***B65D 81/03*** | (2006.01) |
| ***B65D 81/113*** | (2006.01) |
| ***B65D 85/48*** | (2006.01) |
| *B65D 85/44* | (2006.01) |

(58) Field of Classification Search
USPC ..... 206/454, 455, 449, 710, 425, 594, 309, 206/313, 312, 308
See application file for complete search history.

(56) References Cited

U.S. PATENT DOCUMENTS

| | | | | |
|---|---|---|---|---|
| 5,833,063 | A * | 11/1998 | Ho | G11B 33/0422 206/308.1 |
| 5,915,548 | A * | 6/1999 | Sasaki | G11B 23/0236 206/307.1 |
| 6,419,082 | B1 * | 7/2002 | Frankeny | G11B 33/0444 206/308.1 |

FOREIGN PATENT DOCUMENTS

| | | | |
|---|---|---|---|
| CN | 102756861 | A | 10/2012 |
| CN | 105292769 | A | 2/2016 |
| CN | 107380724 | A | 11/2017 |
| CN | 207174451 | U | 4/2018 |
| JP | 2002347843 | A | 12/2002 |
| KR | 101282865 | B1 | 7/2013 |

* cited by examiner

CUSHION STRUCTURE AND PACKAGE BOX

BACKGROUND

Technology Field

This disclosure relates to the technical field of a protection pad, and more particularly to a cushion structure for horizontally stacked package transportation of display glass, and a package box having the cushion structure.

Description of Related Art

At present, expandable polyethylene (EPE, also referred to as pearl cotton) spacers (pads), which are also referred to as EPE folding layers, are widely used as the cushion materials for package and shipment of liquid crystal displays in the liquid crystal panel industry. The shipping of the LCD is always to pack the EPE folding layers and the liquid crystal displays in a separate and stacked manner. By such packing and shipping method, the single one EPE folding layer tends to generate the wrinkle resulted from a vertical displacement of the liquid crystal display, such that the liquid crystal display may be exposed outside, and in turn the rigid collision between the LCDs may occur. Particularly, the rigid collisions may occur at the four corner positions of the LCDs, so that the liquid crystal displays may have ruptures at corners (or sometimes they are the microcracks that cannot be distinguished by the naked eyes), and the connectors on the printed circuit boards (PCB) scratch to each other. It results in defects of, such as, contacts and conductions between the LCDs, and the poor connection of wires.

SUMMARY

An objective of this disclosure is to provide a cushion structure to solve the technical problem, caused by the conventional technique, which are wrinkles of the folding layers cause the display devices to be exposed and ruptures at the corners of the LCD caused by the LCDs scratch to each other.

An objective of this disclosure is achieved by the following technical solution: a cushion structure comprises a cushion pad, a through hole, and a reserved pad. The cushion pad includes a multi-layered folding structure and a plurality of folding layers. One end of one folding layer is connected to one head of another folding layer neighboring to said one of the folding layers, and the folding layers are disposed in an overlapped manner after being folded. An accommodating space is formed between neighboring two of the folding layers, and the accommodating space is configured to accommodate an object. The through hole is disposed on each folding layer to prevent the object from sticking with each folding layer. The reserved pad protrudes from an edge of each folding layer, and two surfaces of the reserved pad are respectively coplanar with two surfaces of said each folding layer.

In one embodiment, the reserved pad is separately disposed on a connecting portion of neighboring two of the folding layers, and the reserved pad is disposed on one side of the accommodating space after the folding layers are folded.

In one embodiment, the width of the reserved pad is smaller than the width of each of the folding layers.

In one embodiment, neighboring two of the reserved pads are separated from each other with a distance.

In one embodiment, the reserved pads are disposed at the same sides of the connecting portions of the folding layers.

In one embodiment, a slit is formed between two neighboring reserved pads.

In one embodiment, neighboring two of the folding layers are integrally formed.

In one embodiment, a plurality of through holes are disposed on each folding layer, and the through holes are rectangular holes which are distributed on each folding layer in a rectangular array.

In one embodiment, the four inner corners of each rectangular hole are filleted.

In one embodiment, a plurality of through holes are disposed on each folding layer, and the through holes are circular holes which are distributed on each folding layer in a rectangular array.

In one embodiment, the through hole is an elliptic-shaped, a regular pentagonal shaped, or a regular hexagonal shaped.

In one embodiment, the folding layer is an expandable polyethylene component.

In one embodiment, a width of the folding layer is greater than or equal to a width of the object.

An objective of this disclosure is also to provide a cushion structure, comprising a cushion pad, a through hole, and a reserved pad. The cushion pad includes a multi-layered folding structure and a plurality of folding layers, and one end of one folding layer is connected to one head of another folding layer neighboring to said one of the folding layers, and the folding layers are disposed in an overlapped manner after being folded. An accommodating space is formed between neighboring two of the folding layers, and the accommodating space is configured to accommodate an object. The through hole is disposed on each folding layer to prevent the object from sticking with each folding layer. The amounts of the through hole are four, and the four through holes are distributed on each folding layer in a rectangular array; and the reserved pad protrudes from an edge of each folding layer, and two surfaces of the reserved pad are respectively coplanar with two surfaces of said each folding layer.

The useful effects of the cushion structure provided by this disclosure are described as follows. Compared with the conventional technology, the cushion structure of this disclosure has the stacked folding layers which are end-to-end connected to each other The conjunction of the neighboring two folding layers can prevent the display device from being exposed outside, avoid the rigid collision between the LCDs, and, more particularly, prevent the four corners of one LCD from colliding with those corners of another LCD and prevent the four corners of one LCD from scratching with the corners of another LCD which may result in the ruptures and cracks at corners of the LCDs. Accordingly, it may provide a very good cushion and protection to the LCD device. In addition, the folding layers which are end-to-end connected to each other may also be easily deployed, organized and flattened, so as to prevent the display devices from being exposed due to the wrinkles caused by the upper and lower shifted glasses, and to avoid rigid collisions and scratches, and to prevent the ruptures and cracks occurred at the corners of LCDs. Hence, it avoids the quality defects occurred during the packing, shipping, and transporting of the LCD devices.

An objective of this disclosure is also to provide a package box, comprising a box body and the aforesaid cushion structure disposed in the box body.

The useful effects of the package box provided by this disclosure are described as follows. Compared with the conventional technology, the package box of this disclosure adopts the above-mentioned cushion structure to package the display devices, so that the display devices are fully accommodated within the package of the cushion structure, and it is possible to avoid ruptures and cracks of the corners of LCDs, caused by the exposed display devices contacting and colliding with the inner wall of the package box. In addition, it is to avoid the product defects occurred during the packaging and transporting processes.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE DISCLOSURE

Figure 1:
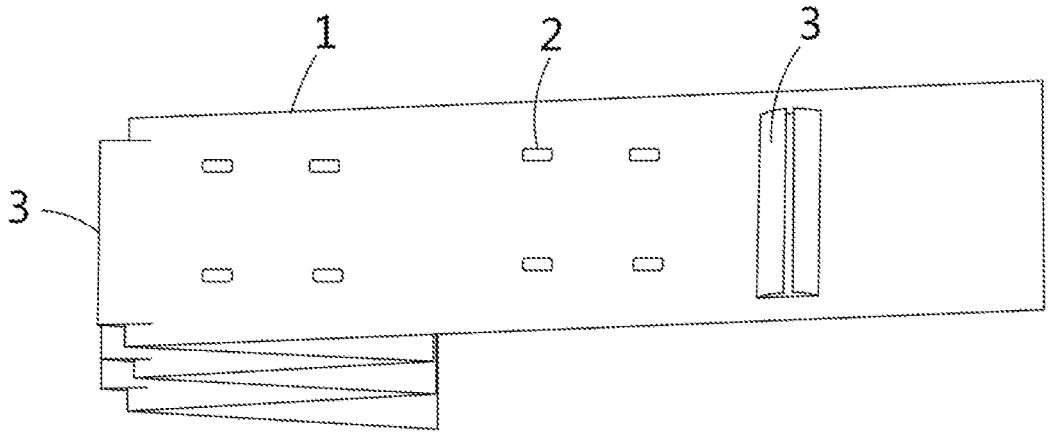
FIG. 1 is a pictorially schematic structure view showing a cushion structure provided by the embodiment of this disclosure.

Specific structures and function details disclosed herein are only for the illustrative purpose for describing the exemplary embodiment of this disclosure. However, this disclosure can be specifically implemented through many replacements, and should not be explained as being restricted to only the embodiment disclosed herein.

In the description of this disclosure, it is to be understood that the terms "center", "transversal", "up", "down", "left", "right", "vertical", "horizontal", "top", "bottom", "inside" and "outside" indicating the orientation or position relationships are the orientation or position relationships based on the drawing, are only provided for the purposes of describing this disclosure and simplifying the description, but do not indicate or imply that the directed devices or elements must have the specific orientations or be constructed and operated in the specific orientations, and thus cannot be understood as the restriction to this disclosure. In addition, the terms "first", and "second" are used for the illustrative purpose only and cannot be understood as indicating or implying the relative importance or implicitly specifying the number of indicated technical features. Therefore, the features restricted by "first" and "second" may expressly or implicitly comprise one or multiple ones of the features. In the description of this disclosure, unless otherwise described, the meaning of "multiple" comprises two or more than two. In addition, the terms "comprises" and any modification thereof intend to cover the non-exclusive inclusions.

In the description of this disclosure, it needs to be described that, unless otherwise expressly stated and limited, the terms "mount", "link" and "connect" should be broadly understood. For example, they may be the fixed connection, may be the detachable connection or may be the integral connection; may be the mechanical connection or may also be the electrical connection; or may be the direct connection, may be the indirect connection through a middle medium or may be the inner communication between two elements. It will be apparent to those skilled in the art that the specific meanings of the above terms in this application may be understood according to the specific conditions.

The terms used herein are for the purpose of describing only specific embodiments and are not intended to limit the exemplary embodiments. Unless the contexts clearly indicate otherwise, the singular form "one", "a" and "an" used here further intend to include plural forms. It should also be understood that the terms "comprising" and/or "including" are used herein to describe the features to describe the presence of stated features, integers, steps, operations, units and/or elements without excluding the presence or addition of one or more other features, integers, steps, operations, units, elements, and/or combinations thereof.

The cushion structure of this disclosure will be described with reference to FIGS. 1 and 2. The cushion structure comprises a cushion pad, a through hole 2 and a reserved pad 3.

The cushion pad includes a multi-layered folding (zigzagged) structure and a plurality of folding layers 1. The end of one of the folding layers 1 is connected to the head of another folding layer 1 which is neighboring to said one of the folding layers 1. The folding layers 1 are disposed in an overlapped manner after being folded.

An accommodating space is formed between neighboring two of the folding layers, and the accommodating space is configured to accommodate an object 1.

The through hole 2 is disposed on each folding layer 1, and prevents the object from sticking with each folding layer 1.

The reserved pad 3 protrudes from an edge of each folding layer 1. Two surfaces of the reserved pad are respectively coplanar with two surfaces of said each folding layer.

The cushion structure provided by this disclosure includes a multi-layered folding structure compared with the conventional technology. The object is accommodated in the accommodating space to avoid the relative displacement between the single-layered object 4 and the folding layer 1. The connection portion between neighboring two of the folding layers 1 can prevent the object from being exposed, avoid the loss of the cushion protection to the edges and the four corners of the object, and prevent one object (especially the four corners of the objects) from colliding with another object. It is possible to avoid the rigid collisions of the four corners of the objects, and prevent the four corners of the one object from scratching with those corners of another object, which may cause the corner rupture and corner crack. Hence, adding a cushion between the display devices may provide a very good protection. In addition, the folding structure can be easily deployed, organized and flattened, so as to prevent the display devices from being exposed due to the wrinkles caused by the upper and lower shifted glasses, and to avoid the rigid collisions and scratches, and to prevent the corner rupture and corner crack. Hence, it is possible to prevent the quality defects from occurring during the packaging, shipping and transporting of the LCD devices.

The packaged object may be: a fragile article, such as a liquid crystal panel, a liquid crystal display, liquid crystal glass plate, an ordinary glass plate or a ceramic plate, or other precision goods that may be easily damaged, such as crafts, electronic apparatuses, detection instruments (i.e., meters), or the like.

In a practicing mode, the cushion pad is formed by folding an integrally formed cushion material. For example, one roll of cushion material with the appropriate width and length can be purchased or customized, and, after folding, the cushion pad is obtained. In addition, by using such folding cushion structure not only protects the four corners of the display devices, but also facilitates the packaging and taking of the display devices. The manufacturing of package is simple.

Figure 2:
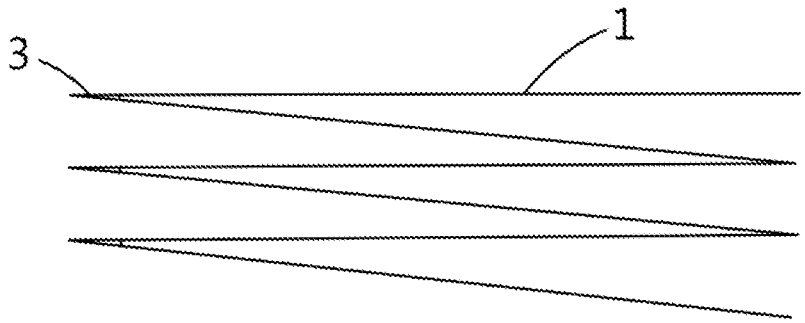
FIG. 2 is a schematic structure side view showing the cushion structure provided by the embodiment of this disclosure.
Figure 3:
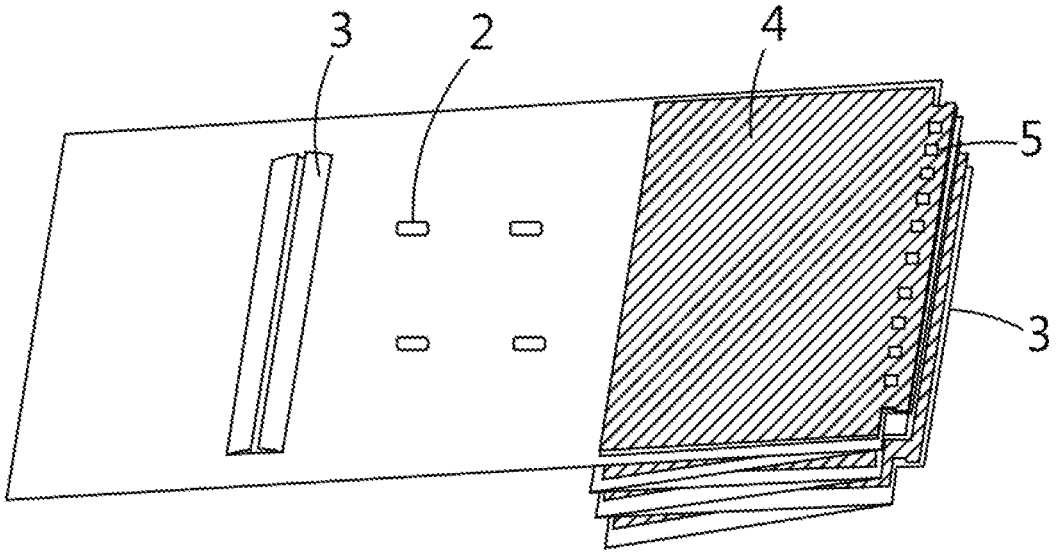
FIG. 3 is a schematic structure view showing a display screen packing state of the cushion structure provided by the embodiment of this disclosure.

In one embodiment, referring to FIGS. 2 and 3 as a specific implementation way of the cushion structure provided by this disclosure, the surface area of the folding layer 1 is equal to the surface area of the target object 4. Specifically, the width of the folding layer 1 is greater than or equal to the width of the target object 4. When the width of the folding layer 1 is greater than the width of the target object 4 by 3 to 5 mm, the extended length of the reserved pad 3 goes beyond the edge of the circuit board 5 by 3 to 5 mm. In a specific practicing mode, the preserved overrunning width may prevent object from being exposed and scratching with the inner wall of the box body of the package box, so as to avoid the damages to the display device.

In one embodiment, referring to FIGS. 1 to 3, the reserved pads 3 are separately disposed on a connecting portion of neighboring two of the folding layers 1. After the folding layers 1 are folded, the reserved pad 3 is disposed on one side of the accommodating space to prevent the accommodated neighboring objects from contacting or colliding with each other.

In one embodiment, for example, the folding layer 1 has a rectangular structure. The reserved pads 3 may also be disposed on other three sides of the folding layer 1 according to the specific structure of the packaged object. It prevents one object from colliding with its neighboring objects when they are shifted, so as to avoid the micro-cracks at the four corners of the object.

In one embodiment, referring to FIGS. 2 and 3, the length and width of each folding layer 1 are the same as the length and width of the to-be-packaged object. It is possible to prevent the relative displacement between the one single object and the folding layer, which results in exposing of the object and loss of the cushion protection.

In one embodiment, as one specific practicing mode of the cushion structure provided by the present disclosure, the width of the reserved pad 3 is smaller than the width of the folding layer 1, and a distance is present between each pair of neighboring reserved pads 3 (i.e., the paired reserved pads 3 are not connected to each other). Specifically, the anti-contact reserved pad 3 is disposed on the conjunctions of the folded folding layers 1 at the same side, and no reserved pad 3 is disposed on the conjunction on the other side of the folding layers 1 after they are folded. The reserved pad 3 has the width smaller than the width of the folding layer 1 and extends outwards, and a slit is formed between two neighboring reserved pads 3 to facilitate the folding. When the object 4 is a display device, the circuit board 5 thereof is disposed between the upper layer and the lower layer of the paired reserved pads 3. On one hand, it is possible to prevent the two circuit boards 5 from contacting and scratching with each other to cause the bad connection. On the other hand, it helps the positioning of the packaged object 4 when it is placed into the cushion structure. For example, when the display devices are disposed in a stacked manner, one end of the circuit board 5 of the display device is inserted into the reserved pads 3, and the display device is slightly pushed until it cannot be moved. The folding layer 1 which the display device is mounted is flattened and has no wrinkle, and no other arranging and pulling operation are required. Hence, the packaging is simple, and the package efficiency is enhanced.

In one embodiment, referring to FIGS. 1 to 3, as one specific practicing mode of the cushion structure provided by the present disclosure, neighboring two of the folding layers 1 are integrally formed. It uses one piece of cushion material to be continuously folded. The manufacturing process is simple.

In one embodiment, referring to FIGS. 2 and 3, as one specific practicing mode of the cushion structure provided by the present disclosure, a plurality of through holes 2 are formed on each folding layer 1. The through holes 2 are provided to prevent the display device from sticking with each folding layer 1. It is possible to prevent the folding layer 1 from getting close to the inner wall of the box body of the package box and from tearing the folding layer 1 upon the displacement of the upper and lower layers. During manufacturing, the through holes 2 can be formed using only the simple punching and cutting process. Hence, the manufacturing cost is low, and the manufacturing cost and the apparatus cost can be saved.

In one embodiment, referring to FIGS. 2 to 3, as one specific practicing mode of the cushion structure provided by the present disclosure, a plurality of through holes 2 are disposed on each folding layer 1. The through holes 2 are rectangular holes distributed on the folding layer 1 in a rectangular array. In specific applications, there may be one, two, three, five, six or other number of through holes 2, but amount is not restricted to those listed in this embodiment. The amount of the holes may be optimized according to the size of the holes to prevent the display device from sticking with the folding layer 1, and to prevent the folding layer 1 from getting close to the inner wall of the box body of the package box and from tearing the folding layer 1 upon displacement of the upper and lower layers.

In one embodiment, the four inner corners of each rectangular hole are filleted. The rectangular hole can be easily formed by one punching and cutting process through one round of punch.

In one embodiment, a plurality of through holes 2 are disposed on each folding layer 1, and the through holes 2 are circular holes which are distributed on each folding layer in a rectangular array. In the embodiment, the through hole 2 is an elliptic-shaped, a regular pentagonal shaped, a regular hexagonal shaped or other polygonal shape, and is not restricted to the shapes listed in this embodiment. The amount of the holes may be optimized according to the size of the holes to prevent the display device from sticking with the folding layer 1, and to prevent the folding layer 1 from getting close to the inner wall of the box body of the package box.

In one embodiment, referring to FIGS. 1 to 3, as one specific practicing mode of the cushion structure provided by the present disclosure, the folding layer 1 is an expandable polyethylene component (i.e., made of the EPE material). The EPE material has the higher resilience and has the white outlook. Because it is a completely independent bubble body, it is light, flexible, and bendable, can absorb an impact force, has the good cushion effect. And it overcomes the drawbacks of the fragile property, deformation and restoration of the ordinary Styrofoam. EPE has the characteristics of thermal insulation, water- and moisture-proof, heat insulation, noise insulation, anti-friction, anti-aging, corrosion-resistance and anti-seismic. It has a strong anti-aging ability and good processability.

In a practicing mode, it is possible to add an antistatic agent to the EPE cushion material during manufacturing. Such method may further provide the resultant product with a function of antistatic, and also increase its anti-tearing ability and anti-UV ability. The package effect is further increased.

An objective of this disclosure is also to provide a cushion structure comprising a cushion pad which includes a multi-layered folding structure and a plurality of folding layers 1. One end of one of the folding layers 1 is connected to one head of another folding layer 1 which is neighboring to said one of the folding layers 1, and the folding layers 1 are disposed in an overlapped manner after being folded. An accommodating space for accommodating an object 4 is formed between neighboring two of the folding layers 1. A through hole 2 is disposed on each folding layer 1 to prevent the object from sticking with the folding layer 1. The amounts of the through hole 2 are four, and the four through holes 2 are distributed on each folding layer 1 in a rectangular array. A reserved pad 3 protrudes from an edge of each folding layer 1. Two surfaces of the reserved pad 3 are respectively coplanar with two surfaces of said each folding layer 1.

Another objective of this disclosure is also to provide a package box, comprising a box body and the aforesaid cushion structure which is disposed in the box body.

The package box of this disclosure uses the above-mentioned cushion structure to package the display devices, so that the display devices are fully accommodated within the package of the cushion structure, and it is possible to avoid the corner rupture and corner crack caused by the exposed display devices contacting and colliding with the inner wall of the package box, and to reduce the product defects resulted from the packaging and transporting processes.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. A cushion structure, comprising:

a cushion pad including a multi-layered folding structure and a plurality of folding layers, wherein one end of one folding layer is connected to one head of another folding layer neighboring to said one of the folding layers, and the folding layers are disposed in an overlapped manner when being folded, wherein an accommodating space is formed between neighboring two of the folding layers, and the accommodating space is configured to accommodate an object;

a through hole, disposed on the folding layer and is configured to prevent the object from sticking with the folding layer; and a reserved pad, protruding from an edge of each folding layer, wherein two surfaces of the reserved pad are respectively coplanar with two surfaces of said each folding layer, wherein a slit is formed between two neighboring reserved pads.

2. The cushion structure according to claim 1, wherein the reserved pad is separately disposed on a connecting portion of neighboring two of the folding layers, and the reserved pad is disposed on one side of the accommodating space after the folding layers are folded.

3. The cushion structure according to claim 2, wherein the width of the reserved pad is smaller than the width of said each the folding layer.

4. The cushion structure according to claim 3, wherein neighboring two of the reserved pads are separated from each other with a distance.

5. The cushion structure according to claim 1, wherein the reserved pads are disposed at the same sides of the connecting portions of the folding layers.

6. The cushion structure according to claim 1, wherein neighboring two of the folding layers are integrally formed.

7. The cushion structure according to claim 1, wherein a plurality of through holes are disposed on each folding layer, and the through holes are rectangular holes which are distributed on each folding layer in a rectangular array.

8. The cushion structure according to claim 1, wherein a plurality of through holes are disposed on each folding layer, and the through holes are circular holes which are distributed on each folding layer in a rectangular array.

9. The cushion structure according to claim 1, wherein the through hole is an elliptic-shaped, a regular pentagonal shaped, or a regular hexagonal shaped.

10. The cushion structure according to claim 1, wherein the folding layers are expandable polyethylene components.

11. The cushion structure according to claim 1, wherein a width of each folding layer is greater than or equal to a width of the object.

12. A cushion structure, comprising:

a cushion pad including a multi-layered folding structure and a plurality of folding layers, wherein one end of one folding layer is connected to one head of another folding layer neighboring to said one of the folding layers, and the folding layers are disposed in an overlapped manner after being folded, wherein an accommodating space is formed between neighboring two of the folding layers, and the accommodating space is configured to accommodate an object;

a through hole, disposed on each folding layer and prevents the object from sticking with the folding layer, wherein the amounts of the through holes are four, and the four through holes are distributed on each folding layer in a rectangular array; and a reserved pad, protruding from an edge of each folding layer, wherein two surfaces of the reserved pad are respectively coplanar with two surfaces of said each folding layer, wherein a slit is formed between two neighboring reserved pads.

13. The cushion structure according to claim 12, wherein the reserved pad is separately disposed on a connecting portion of neighboring two of the folding layers, and the reserved pad is disposed on one side of the accommodating space after the folding layers are folded.

14. The cushion structure according to claim 13, wherein the width of the reserved pad is smaller than the width of each of the folding layers.

15. The cushion structure according to claim 14, wherein neighboring two of the reserved pads are separated from each other with a distance.

16. The cushion structure according to claim 12, wherein the reserved pads are disposed at the same sides of the connecting portions of the folding layers.

17. A package box, comprising:

a box body; and a cushion structure according to claim 1 disposed in the box body.

* * * * *